United States Patent [19]

Dobrovolny et al.

[11] Patent Number: 4,663,070

[45] Date of Patent: May 5, 1987

[54] PROCESS FOR PREPARING SOAP-ACYL ISETHIONATE TOILET BARS

[75] Inventors: Mark S. Dobrovolny, Edison, N.J.; James J. Corr, Huntington, N.Y.; William R. Narath, Parsippany, N.J.

[73] Assignee: Lever Brothers Company, New York, N.Y.

[21] Appl. No.: 694,869

[22] Filed: Jan. 25, 1985

[51] Int. Cl.[4] ..... G11D 17/00

[52] U.S. Cl. ..... 252/121; 252/134; 252/174; 252/538; 252/554; 252/557; 252/DIG. 16

[58] Field of Search ..... 252/117, 121, 134, 174, 252/538, 554, 557, DIG. 16

[56] References Cited

U.S. PATENT DOCUMENTS

| | | | |
|---|---|---|---|
| 3,376,229 | 4/1968 | Haass | 252/117 |
| 3,989,647 | 11/1976 | Prince | 252/535 |
| 4,180,470 | 12/1979 | Tokosh et al. | 252/121 |
| 4,211,675 | 7/1980 | Machin | 252/121 |
| 4,231,904 | 11/1980 | Machin | 252/121 |
| 4,260,507 | 4/1981 | Barrett | 252/121 |

FOREIGN PATENT DOCUMENTS

| | | |
|---|---|---|
| 6603918 | 3/1966 | Netherlands . |
| 783027 | 9/1957 | United Kingdom . |

*Primary Examiner*—Paul Lieberman
*Assistant Examiner*—Hoa Van Le
*Attorney, Agent, or Firm*—Milton L. Honig; James J. Farrell

[57] ABSTRACT

A process is disclosed for preparing a toilet bar composition whose components comprise a fatty acid soap and a $C_{10}$–$C_{16}$ acyl isethionate salt in the ratio of about 20:1 to 1:0.98, respectively. The blend is charged with an initial amount of water from 12 to 30% by weight of the composition. Heating and mixing are terminated after the blend has passed a second peak in viscosity, termination occurring between about 500 and 6,000 centipoise at 35 $sec^{-1}$ shear rate at 210°–218° F. The final moisture content of the blend must be between 8.5 to 20% water.

20 Claims, 1 Drawing Figure

PROCESS FOR PREPARING SOAP-ACYL ISETHIONATE TOILET BARS

BACKGROUND OF THE INVENTION

1. Field of the Invention

The invention relates to a process for preparing toilet bars comprising as surface active components a major amount of soap and a minor amount of acyl isethionate salt.

2. The Prior Art

For many people, toilet bar and soap are synonymous terms. This derives from soap being the primary active and major component of most commercial bars. Soap has the enviable properties of being inexpensive and an efficient cleanser. Shortcomings in mildness and lather have, however, been noted. These deficiences may be remedied by replacing substantially all of the soap with sodium acyl isethionate. Some thirty years ago, a bar of this composition was successfully introduced into commerce.

Toilet bars wherein sodium acyl isethionate constitutes the major active are mild and of good lather. However, they suffer in properties where soaps perform well. Specifically, sodium acyl isethionates are soft and produce the phenomena of mush. Consequently, there have been proposals for combining the two actives in a toilet bar to achieve the desirable properties of each but avoiding their separate disadvantages.

The prior art discloses bars which contain major amounts of soap and minor amounts of sodium acyl isethionate. For instance, U.S. Pat. No. 4,260,507 reports a bar containing from 60 to 97% soap and 3 to 40% sodium acyl isethionate.

Within the literature are detailed many criticalities in the processing of toilet bars. U.S. Pat. No. 3,989,647 reports bars containing alkane sulfonate and various binder modifiers such as acyl isethionates processed with water initially added in an amount sufficient to obtain a final water content of about 5 to 25%. U.S. Pat. No. 3,376,229 discloses that bars with major amounts of sodium acyl isethionate and minor amounts of soap are best limited to a water content below 4–5% to avoid softness. Components are blended at about 235° F. Dutch Patent Application No. 6603918 describes acyl isethionate, optionally combined with minor amounts of soap, being processed at temperatures from 100° to 110° C., the water component being controlled to obtain from 5 to 15% water in the product.

It is an object of this invention to provide a process for preparing toilet bars containing a major amount of soap and a minor amount of sodium acyl isethionate.

A further object of this invention is to obtain by this method, a toilet bar having consumer use and processing properties that fall within commercially acceptable parameters.

SUMMARY OF THE INVENTION

A process for preparing a toilet bar composition is hereby provided comprising:

(i) blending components comprising:

(a) an alkali metal, ammonium or $C_1$–$C_4$ alkyl or hydroxyalkyl substituted ammonium fatty acid soap in an amount greater than 25%;

(b) a $C_{10}$–$C_{16}$ acyl isethionate salt the ratio of soap to acyl isethionate salt ranging from about 20:1 to 1:0.98; and (c) from 12 to 30% initial water;

(ii) heating and mixing the component blend; and (iii) terminating mixing after the blend passes a second peak in viscosity, termination occurring at a blend viscosity between about 500 and 6,000 centipoise at 35 $sec^{-1}$ shear rate at 210°–218° F., the final moisture content of the blend being between 8.5 to 20% water.

DETAILED DESCRIPTION OF THE INVENTION

Figure 1:
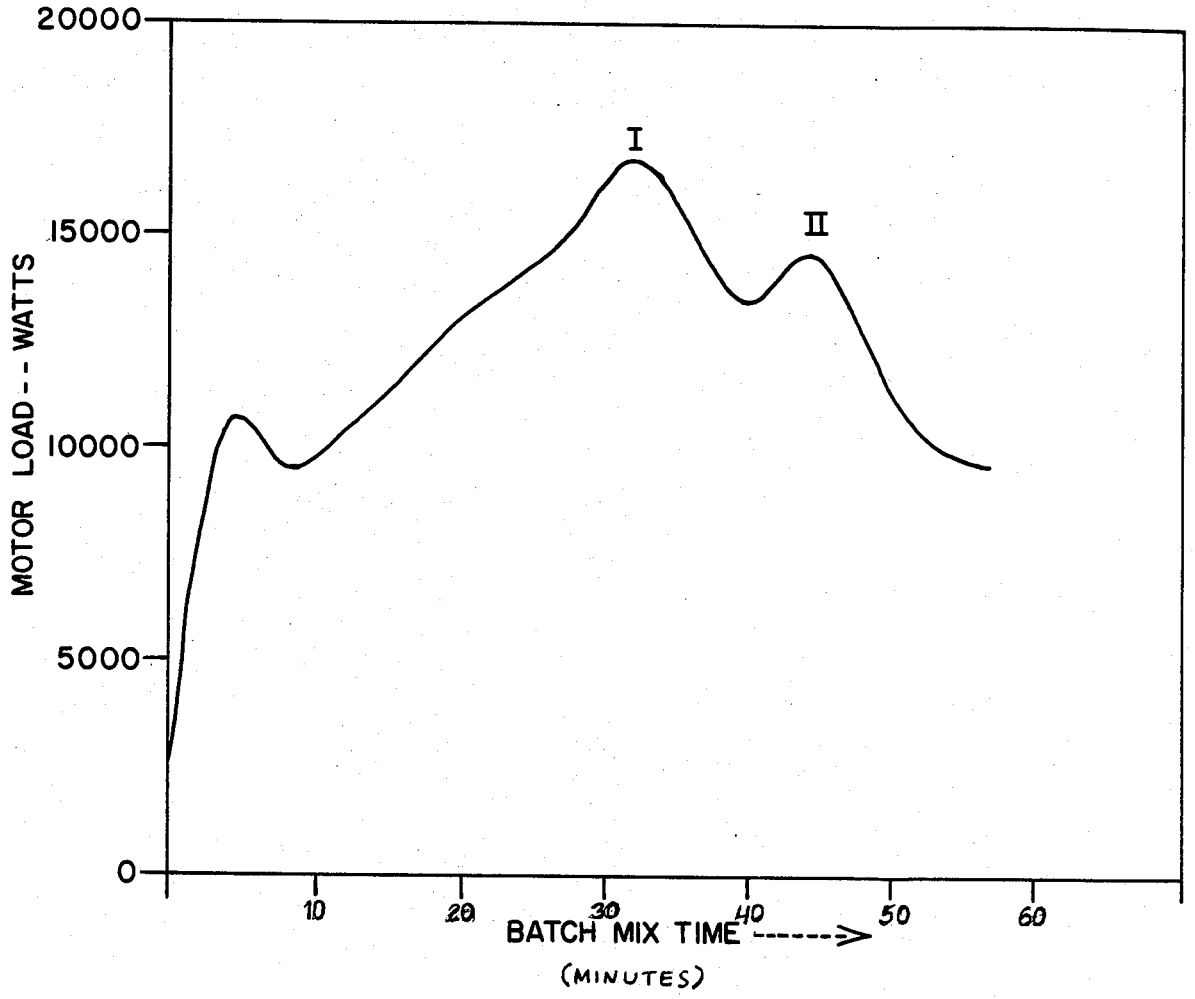

In developing a bar with a major amount of soap and a minor amount of sodium acyl isethionate, it has been observed that the bar's physical properties are affected by the processing conditions of water and temperature. Initial water charge has been found critical. The critical range lies between about 12 and 30% water, based on weight of the total charge; preferably between about 16 to 25% and more preferably between about 20% to 22%. Initial moisture levels of less than 12% result in bars having an undesirable sandy texture.

Upon completion of processing, a final water content of between about 8.5 and 20% is found necessary for the bar to exhibit adequate performance. Preferably, the final water content is from about 9.15 to 14%.

It has been discovered that the reaction must be terminated at or within a short time, generally about 1 to 60 minutes, preferably about 1 to 15 minutes, of the reaction mixture having reached a second viscosity peak. Where viscosity has significantly decreased from the second peak value, bar properties are no longer optimum and, in fact, commercially unacceptable.

Relative viscosity was determined by measuring stirrer motor load through means of a watt transducer. The instrument measures the power being consumed in a load. The device is available from Vespo Marketing, Inc. and sold as the PC 5 watt transducer. Power consumption of the stirrer is proportional to the viscosity of the composition being stirred.

FIG. 1 graphs the relationship between viscosity, expressed in motor load (watts), versus batch mix time at reaction temperatures.

An initial rise in motor load occurs following the addition of soap, preservatives, stearic acid and acyl isethionate salt. Addition of an aqueous sodium (unesterified) isethionate solution momentarily decreases the blend viscosity. Once all reactants have been charged to the vessel, a steady increase in motor load occurs culminating in a peak viscosity (I). Within a relatively short time, a sudden decrease and then increase in motor load occurs. A second, but lower viscosity peak (II) is noted. If the reaction is not quickly thereafter terminated, then the resultant composition will have inferior performance and bar processsing properties.

The reaction end-point may also be visually determined. A distinct phase change occurs at the end-point with the formulation's dough-like appearance transforming into a soupy consistency. Shortly after the reaction mass has attained the soupy consistency, processing should be terminated.

The term "soap" is used herein in its popular sense, i.e., the alkali metal or alkanol ammonium salts of aliphatic alkane- or alkene monocarboxylic acids. Sodium, potassium, mono-, di- and tri-ethanol ammonium cations, or combinations thereof, are suitable for purposes of this invention. The term substituted ammonium is intended hereinafter to cover $C_1$–$C_4$ alkyl and hydroxyalkyl substituted nitrogen cations. In general, sodium soaps are used in the compositions of this invention, but from about 1% to about 25% of the soap may be potassium soaps. The soaps useful herein are the well known alkali metal salts of natural or synthetic alphatic (alkanoic or alkenoic) acids having about 12 to 20 carbon atoms, preferably about 12 to about 18 carbon atoms. They may be described as alkali metal carboxylates of acyclic hydrocarbons having about 12 to about 20 carbon atoms.

Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are $C_{16}$ and higher. Preferred soap for use in the compositions of this invention has at least about 85% fatty acids having about 12–18 carbon atoms.

Coconut oil employed for the soap may be substituted in whole or in part by other "high-lauric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

A preferred soap feed stock is a mixture of about 15% to about 20% coconut fatty acids and about 80% to about 85% tallow fatty acids. These mixtures contain about 95% fatty acids having about 12 to about 18 carbon atoms. The soap may be prepared from coconut oil, in which case the fatty acid content is about 85% of $C_{12}$–$C_{18}$ chain length.

The soaps may contain unsaturation in accordance with commercially acceptable standards. Excessive unsaturation is normally avoided.

Soaps may be made by the classic kettle boiling process or modern continuous soap manufacturing processes wherein natural fats and oils such as tallow fat or coconut oil or their equivalents are saponified with an alkali metal hydroxide using procedures well known to those skilled in the art. Alternatively, the soaps may be made by neutralizing fatty acids, such as lauric ($C_{12}$), myristic ($C_{14}$), palmitic ($C_{16}$), or stearic ($C_{18}$) acids with an alkali metal hydroxide or carbonate.

Total soap content of the instant compositions must be greater than 25 wt.%. Usually, from about 30% to 98% of the composition is soap. Preferably, the concentration of this component ranges from about 50% to 70%.

Soap is preferably the major surfactant component of the bar. The ratio of soap to acyl isethionate salt may vary from about 20:1 to 1:0.98, respectively. Preferably, the ratio is held between about 10:1 to 1.5:1, most preferably about 4:1 to 1.5:1.

The acyl isethionate esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionate ester salts will generally range from about 2% to about 45% by weight of the total composition. Preferably, this component is present from about 10% to about 30%, more preferably 15% to 25%.

Unesterified isethionate salt may also be incorporated into the bar. Unesterified isethionate may be present from about 0.5 to about 50%. Preferably, this material is present from about 2% to about 25%, more preferably from about 2.5% to about 15% by weight of the total composition.

Effective cations for both the esterified and unesterified isethionate salt may be selected from the group consisting of alkali metal, alkaline earth metal, ammonium, alkyl ammonium and mono-, di- or tri-alkanolammonium ions. Specifically preferred cations include sodium, potassium, lithium, calcium, magnesium, ammonium, triethylammonium, monoethanolammonium, diethanolammonium or triethanolammonium ions.

Other performance chemicals may be added with these compositions. For instance, from 2 to 10% of a suds-boosting detergent salt may be incorporated. This type additive may be selected from the group consisting of alkali metal and organic amine higher aliphatic fatty alcohol sulfates, alkyl aryl sulfonates and the higher aliphatic fatty acid taurinates.

A superfatting agent to further enhance mildness and reduce mush properties may be included, for example, a fatty acid of carbon atoms numbering 10–18, preferably 10–16 in an amount up to 25% by weight of the composition.

Adjunct materials including germicides, perfumes, and colorants, such as titanium dioxide, may also be present.

The following examples will more fully illustrate the embodiments of this invention. All parts, percentages and proportions referred to herein and in the appended claims are by weight of the total composition unless otherwise stated.

EXAMPLE 1

Illustrative of a toilet bar that has been prepared by the process of this invention is one whose formulation appears below.

TABLE I

Toilet Bar Formulation Containing Soap/Acyl Isethionate

| Components | Weight % |
|---|---|
| Sodium Soap (82/18)* | 50.73 |
| Sodium cocoyl isethionate | 21.74 |
| Water (final content) | 11.70 |
| Stearic Acid | 6.98 |
| Sodium isethionate | 5.00 |
| Miscellaneous (perfume, colorants, preservatives) | 2.10 |
| Coconut fatty acid | 1.32 |
| Sodium chloride | 0.43 |

*Tallow to coconut oil ratio

Toilet bars with the above formulation were made using a Day Mixer. Steam was used to preheat the mixer. The designated soap charge was pumped into the vessel and agitation begun. Immediately thereafter, stearic acid, sodium acyl isethionate, coconut fatty acid, sodium isethionate, sodium chloride and the miscellaneous minor components were charged to the reactor. Initial moisture level was 19.83%.

FIG. 1 outlines the change in viscosity as reflected by motor load (watts) versus batch mix time. An initial peak was observed within the first few minutes of blending at about 200° F. This viscosity peak was due solely to introduction of reactants. Thereafter, viscosity steadily rose while the temperature was maintained between about 205° and 217° F. Within about 30 minutes, viscosity had reached a maximum of 17,000 watts (peak I). A sudden decrease from peak I viscosity was then followed by an increase in motor load reaching a second, but lower, peak II viscosity of 15,000 watts. The reaction was immediately terminated thereupon in the 9,000 to 10,000 watt range. Termination was accomplished by release of reactant blend from the Day Mixer onto a doctor roll hopper of a chill roll.

Peak II occurred between 40 and 45 minutes into the reaction cycle. Total batch mix times, as determined through repeated runs, ranged from 60 to 100 minutes. The resultant compositions were, thereafter, subjected to milling, plodding and stamping operations.

Apparent viscosity values were also obtained for the reactant blend at a time just prior and subsequent to reaction end-point. A Haake Viscometer, Model VT24 MV/SV DIN, was utilized for these measurements. Data is presented in Table II below. Series A measurements were performed upon the reaction mixture while in the doughy state at 200°-205° F. Series B presents viscosity data for the reaction mixture in the soupy state, i.e. shortly after the blend has reached the second peak in viscosity. The temperature at which measurements were taken in Series B was between 210° and 218° F. No significant difference in viscosity values are believed to occur due to the variations in temperature at which viscosity was measured. Apparent viscosity numbers in Series A are minimum values; actual apparent viscosity is probably higher than observed because of experimental difficulties with probing a spinning viscous mass.

TABLE II

Apparent Viscosity Data Distinguishing Doughy From Soupy States in Processing the Formulation of Example 1

| | Shear Rate ($sec^{-1}$) | Shear Stress (Pa) | Apparent Viscosity (Cp) |
|---|---|---|---|
| Series A - Doughy State | 35.04 | 420.0 | 11,986 |
| | 17.52 | 353.5 | 20,177 |
| | 8.76 | 343.0 | 39,155 |
| | 4.38 | 266.0 | 60,731 |
| | 2.19 | 199.5 | 91,096 |
| | 1.095 | 154.0 | 140,639 |
| Series B - Soupy State | 35.04 | 118.00 | 3,368 |
| | 17.52 | 126.85 | 7,240 |
| | 8.76 | 112.10 | 12,797 |
| | 4.38 | 102.07 | 23,304 |
| | 2.19 | 98.53 | 44,991 |
| | 1.095 | 94.40 | 86,210 |

Since the reaction mass is a non-Newtonium fluid, different apparent viscosities were obtained with different shear rates (stirrer speeds). As shear rate increases, apparent viscosity decreases. The values in Table II, Series B, indicate that when the blend reaches beyond peak II and achieves a soupy state, the typical apparent viscosity is about 3,000 centipoise at 35 $sec^{-1}$ shear rate. The reaction must be terminated when the blend has attained an apparent viscosity ranging between about 500 and 6,000 centipoise at 35 $sec^{-1}$ shear rate at 210°-218° F. Preferably, the range should be between about 2,000 and 4,000 centipoise at 35 $sec^{-1}$ shear rate at 210°-218° F.

EXAMPLES 2-6

Other toilet bars that may be prepared by the process of this invention are illustrated by Examples 2-6 whose formulations appear below.

TABLE III

Toilet Bar Formulations Containing Soap/Acyl Isethionate

| Components | Example 2 | 3 | 4 | 5 | 6 |
|---|---|---|---|---|---|
| Sodium Soap (82/18) | 46.53 | 54.27 | 36.74 | 57.98 | 65.22 |
| Sodium cocoyl isethionate | 19.94 | 23.26 | 35.73 | 14.49 | 7.25 |
| Water (final content) | 14.00 | 9.00 | 11.50 | 11.50 | 11.50 |
| Stearic Acid | 6.40 | 7.47 | 6.98 | 6.98 | 6.98 |
| Sodium isethionate | 10.00 | 2.14 | 5.00 | 5.00 | 5.00 |
| Coconut fatty acid | 1.21 | 1.41 | 1.32 | 1.32 | 1.32 |
| Sodium chloride | 0.40 | 0.46 | 0.43 | 0.43 | 0.43 |
| Miscellaneous (Perfume, colorants, preservatives) | 1.52 | 1.99 | 1.70 | 1.70 | 1.70 |

EXAMPLE 7

This Example demonstrates the importance of allowing the reaction to proceed past the doughy state, i.e. past peak II, before terminating the reaction.

A composition as outlined in Table I was processed according to Example 1 with the following exception. The reaction was terminated prior to the blend having attained the peak II viscosity. The batch was discharged in its highly viscous doughy state. The resultant product was too soft for extrusion. Bars prepared from this blend were difficult to pack and stamp because of bar deformation and stickiness, respectively.

A second reaction was run to demonstrate the importance of terminating the mixing process within a short time after peak II viscosity has been attained. This reaction blend was discharged for cooling long after peak II occurred (greater than two hours). Product resulting therefrom was very difficult to extrude (i.e. dry and of low cohesive strength) and difficult to stamp. Stress markings were observed on the bar surface.

User and bar processing properties of materials prepared in the two aforementioned reactions are presented in Table IV. Sample D is the product corresponding to the batch that was discharged in its doughy state. Sample S corresponds to the batch discharged long after the soupy state, i.e. peak II, was attained. Sample 1 refers to material prepared according to Example 1.

TABLE IV

Toilet Bar User Properties

| Sample No. | Final Moisture % | Lather* (ml) 75 | 95 | 105 | Mush (50 cm sq) |
|---|---|---|---|---|---|
| D | 14.6 | 90 | 80 | 75 | 14.77 |
| S | 8.8 | 90 | 80 | 70 | 16.24 |
| 1 (Control) | 11.7 | 95 | 95 | 85 | 14.46 |

*Lather measurements were taken at 75°, 95° and 105° F. wash temperature.

Toilet Bar Physical Properties

| Sample No. | Face Cracking** | End Cracking** |
|---|---|---|
| D | 0.3 | 0.0 |
| S | 0.0 | 1.0 |
| 1 (Control) | 0.1 | 0.0 |

**Bar cracking scale:
0.0 = none
1.0 = severe and unacceptable

Table IV indicates that mush, lather and cracking are inferior for bars prepared through a reaction terminated either too soon or too late. Thus, Sample 1 bars exhibit lower mush and better lather than those of Samples D and S. Overall cracking of Sample 1 bars was less than with Sample D and S bars.

EXAMPLES 8–16

The following illustrates the process carried out in a Patterson batch mixing vessel of 30 pounds (4 gallons) capacity.

To the reactor were added stearic acid (11.25%), sodium chloride (6.5%), flaked sodium acyl isethionate, soap flakes and water. Table V lists the various examples as to their actives content by ratio of soap to acyl isethionate. Final bar moisture content is also therein reported. Starting water content was 20% for all the examples.

Throughout the mixing cycle, the agitator blades were maintained at 90 rpm speed providing low to moderate shear to the components. The vessel was preheated and the raw materials charged. Subsequent to charging, the vessel was covered and mixing maintained at 230° F. for 15 minutes. The reactor cover was then removed and water permitted to evaporate. Batch mix time cycles were maintained at around an average of 95 minutes. Reaction temperatures were maintained at around 230° F. throughout the evaporation process.

Batch motor load is monitored throughout the reaction. Shortly after reaching a second motor load maximum, peak II, the reaction is terminated.

The batch was then discharged and chill rolled at 100° F. Chip temperature was adjusted by controlling the cooling water flow rate through the rolls. The chill rolled chips were then milled. Milled material was then refined and extruded into logs in a 6 inch refiner/plodder. A Jones press was utilized to press the log into a standard brick.

TABLE V

| Example No. | Ratio Soap/ Acyl Isethionate | Final Bar Moisture (%) |
|---|---|---|
| 8 | 60/40 | 7.8 |
| 9 | 60/40 | 11.58 |
| 10 | 60/40 | 10.88 |
| 11 | 80/20 | 5.58 |
| 12 | 80/20 | 7.91 |
| 13 | 80/20 | 11.30 |
| 14 | 70/30 | 7.20 |
| 15 | 70/30 | 8.83 |
| 16 | 70/30 | 9.35 |

TABLE VI

| | Processing Responses | | | | | |
|---|---|---|---|---|---|---|
| Example No. | P1 | P2 | P3 | P4 | P5 | P6 |
| 8 | 2 | 2 | 1 | 1 | 2 | 3 |
| 9 | 2 | 1 | 1 | 1 | 1 | 3 |
| 10 | 1 | 1 | 1 | 1 | 3 | 2 |
| 11 | 4 | 4 | 1 | 4 | 1 | 1 |
| 12 | 4 | 2 | 1 | 2 | 1 | 1 |
| 13 | 1 | 1 | 1 | 1 | 3 | 3 |
| 14 | 3 | 4 | 1 | 4 | 4 | 4 |
| 15 | 1 | 1 | 1 | 1 | 2 | 1 |
| 16 | 2 | 1 | 1 | 1 | 1 | 1 |

| | Scale |
|---|---|
| P1 - Milling | 1 = Excellent to 4 = Unacceptable |
| P2 - Plodding | 1 = Excellent to 4 = Unacceptable |
| P3 - Bridging | 1 = None to 4 = Excessive |
| P4 - Brittleness | 1 = Malleable to 4 = Brittle |
| P5 - Tackiness | 1 = None to 4 = Excessive |

TABLE VI-continued

| | |
|---|---|
| P6 - Stamping | 1 = Excellent to 4 = Unacceptable |

Table VI lists the various response factors involved in processing the toilet bar formulations of Table V. Milling is an operation wherein the plastic formulation is worked between a series of metal rollers. Processing difficulties are encountered where material does not adhere to the roll surface. Material drop-off percentages were measured in assessing acceptability of milling. Throughput rate was an additional factor in assessing milling acceptability.

Plodding is a process wherein milled material is heated, mixed and extruded through a mixing chamber. Temperatures varied between 95° and 110° F. Plodding times for the 30 pound batch varied from 12 to 20 minutes. Materials having shorter plodding temperature and times were considered more acceptable than those exhibiting values at the upper range.

Interchamber bridging is a term referring to the buildup of material on the inter-chamber walls of a plodder apparatus. Such buildup is undesirable.

Stampability is the ease with which a milled and plodded material may be shaped into bar form. If the material is too hard, more pressure and slower rates of stamping occur.

Three examples of a 60/40 ratio actives toilet bar were evaluated for processing responses. Examples 9 and 10 were formulated to contain a final bar moisture content above 8.5%. Overall, processing with these formulations were better than with Example 8 having slightly less than 8.5% moisture content.

Examples 11–13 contain an active ratio of 80/20. Overall, formulation 13 with moisture content of 11.3 was easier to process than formulations 11 and 12. The latter two contain less than 8.5% final moisture content. Especially poor were the milling and plodding aspects of Examples 11 and 12. Example 13 did have some deficiency in tackiness and stamping.

The 70/30 active ratio is exemplified by formulations 14–16. Formulation 14 was found to process substantially inferior to that of 15 and 16. Example 14 contains less than 8.5% final moisture content.

The foregoing description and examples illustrate selected embodiments of the present invention and in light thereof various modifications will be suggested to one skilled in the art, all of which are within the spirit and purview of this invention.

What is claimed is:

1. A process for preparing a toilet bar composition comprising:

(i) blending components comprising:

(a) an alkali metal, ammonium or $C_1$–$C_4$ alkyl or hydroxyalkyl substituted ammonium fatty acid soap in an amount greater than 25%;

(b) a $C_{10}$–$C_{16}$ acyl isethionate salt the ratio of soap to acyl isethionate salt ranging from about 20:1 to 1:0.98; and (c) from 12 to 30% initial water based on the weight of the total charge;

(ii) heating and mixing the component blend; and (iii) terminating mixing after the blend passes a second peak in viscosity, any peaks due solely to introduction of reactants not being counted as a peak in viscosity, termination occurring at a blend viscosity between about 500 and 6,000 centipoise at 35 $sec^{-1}$ shear rate at 210°–218° F., the final moisture content of the blend being between 8.5 to 20% water.

2. A process according to claim 1 wherein the ratio of soap to acyl isethionate ranges from about 10:1 to 1:0.98.

3. A process according to claim 1 wherein the ratio of soap to acyl isethionate ranges from about 4:1 to 1.5:1.

4. A process according to claim 1 wherein the mixing temperature ranges from above about 200° to 250° F. at atmospheric pressure or from 80° to 200° F. below atmospheric to about 10 mm pressure.

5. A process according to claim 4 wherein the temperature ranges from 200° to 230° F. at atmospheric pressure.

6. A process according to claim 1 wherein the reaction time ranges from about 60 to 100 minutes.

7. A process according to claim 1 wherein the initial water content ranges from about 20 to 22%.

8. A process according to claim 1 wherein the final moisture content ranges from about 9.5 to 14%.

9. A process according to claim 1 wherein the soap is present in an amount from about 30% to 95.2%.

10. A process according to claim 1 wherein the soap is present from about 50 to 70%.

11. A process according to claim 1 wherein the alkali metal of the fatty acid soap is sodium or potassium.

12. A process according to claim 1 wherein the acyl isethionate salt is present from about 5 to 45% by weight of the total composition.

13. A process according to claim 1 wherein the acyl isethionate salt is present from about 10 to 30% by weight of the total composition.

14. A process according to claim 1 wherein the acyl isethionate salt is a sodium or potassium salt.

15. A process according to claim 1 further comprising from about 0.5 to 30% sodium isethionate by weight of the total composition.

16. A process according to claim 1 further comprising from about 2.5 to 15% sodium isethionate by weight of the total composition.

17. A process according to claim 1 further comprising from about 1% to about 30% $C_{10}$–$C_{18}$ free fatty acid.

18. A process according to claim 17 wherein the fatty acid is stearic or coconut fatty acid.

19. A process according to claim 1 wherein mixing is terminated after the blend reaches a viscosity between about 2,000 and 4,000 centipoise at 35 $sec^{-1}$ shear rate at 210°–218° F.

20. A method for identifying the end-point of a toilet bar composition reaction process wherein the end-point is identified by the attainment of a second peak in viscosity, any peaks due solely to introduction of reactants not being counted as a peak in viscosity, of a formulation comprising:

(i) blending components comprising:

(a) an alkali metal, ammonium or $C_1$–$C_4$ alkyl or hydroxyalkyl substituted ammonium fatty acid soap in an amount greater than 25%;

(b) a $C_{10}$–$C_{16}$ acyl isethionate salt, the ratio of soap to acyl isethionate salt ranging from about 20:1 to 1:0.98; and (c) from 12 to 30% initial water;

(ii) heating and mixing the component blend; and (iii) terminating mixing after the blend passes a second peak in viscosity, any peaks due solely to introduction of reactants not being counted as a peak in viscosity, termination occurring at a blend viscosity between about 500 and 6,000 centipoise at 35 $sec^{-1}$ shear rate at 210°–218° F., the final moisture content of the blend being between 8.5 to 20% water.

* * * * *